United States Patent [19]

Bowen

[11] Patent Number: 4,998,731

[45] Date of Patent: Mar. 12, 1991

[54] GOLF PUTTING AND SWING AID FOR PRACTICE

[76] Inventor: John H. Bowen, 2705 Kay St., Eu Claire, Wis. 54701

[21] Appl. No.: 523,028

[22] Filed: May 14, 1990

[51] Int. Cl.[5] ..... A63B 69/36

[52] U.S. Cl. ..... 273/183 B; 273/187 R; 273/190 R; 273/191 R; 434/252

[58] Field of Search ..... 273/35 R, 183 R, 183 B, 273/186 R, 186 A, 187 R, 190 R, 190 A, 190 B, 190 C, 190 D, 190 E, 191 R, 191 B, 193 A, 193 B, 194 B, 178 A, 178 B, 176 H, 77 R; 434/252

[56] References Cited

U.S. PATENT DOCUMENTS

| | | | |
|---|---|---|---|
| 2,611,610 | 9/1952 | Hara | 273/183 B |
| 3,623,733 | 11/1971 | Cavanaugh | 273/183 B |
| 3,712,625 | 1/1973 | Taylor | 273/190 R |
| 3,770,280 | 11/1973 | Straus | 273/183 B |
| 4,521,023 | 6/1985 | Williams | 273/183 B |
| 4,583,738 | 4/1986 | Fava | 273/190 R X |
| 4,659,084 | 4/1987 | Vuick | 273/183 B |
| 4,758,000 | 7/1988 | Cox | 273/190 R |
| 4,900,030 | 2/1990 | Houtz | 273/183 E |

*Primary Examiner*—William H. Grieb

[57] ABSTRACT

An improved golf practice device that is able to train all aspects of the golf game. It is a simple tubular structure that can hold and guide the different parts of the body to get the proper feel of putting, chipping, pitching, full swing and bunker shots. The practice aid is of light-weight construction and capable of easy disassembly for portability.

2 Claims, 4 Drawing Sheets

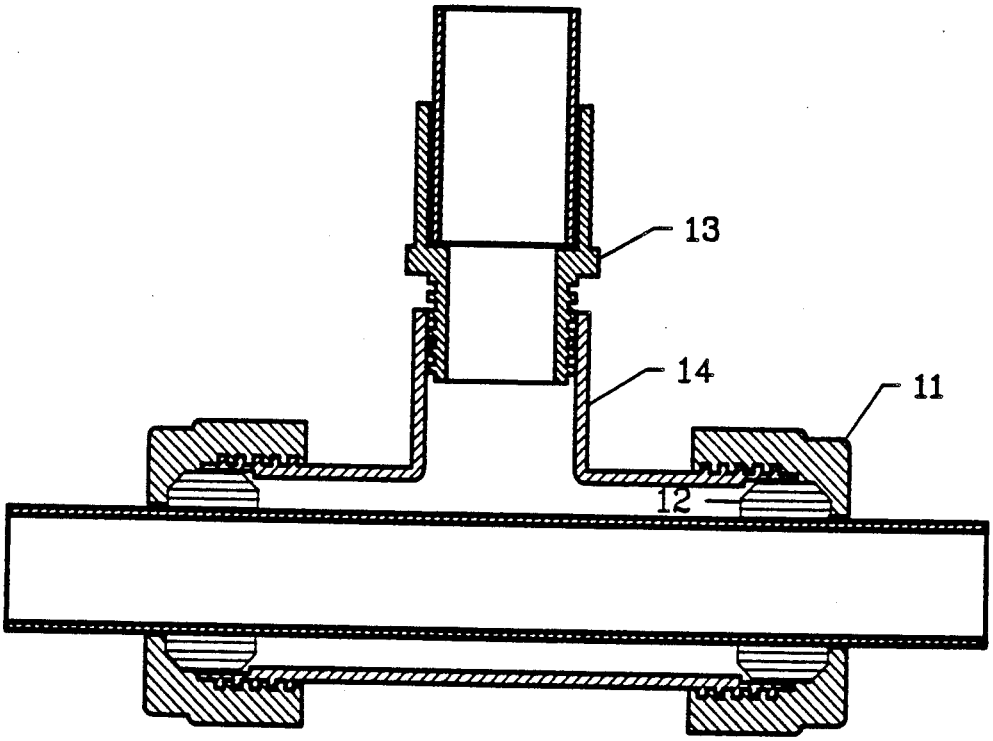
FIG. 4: PART #1,2,3,4,8,&9
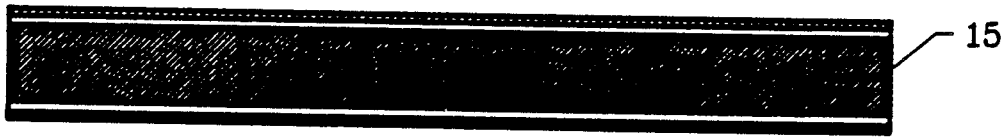
FIG. 5: PART #6

GOLF PUTTING AND SWING AID FOR PRACTICE

BACKGROUND—FIELD OF INVENTION

The golf practice aid is for helping a golfer get the feel of a proper putting stroke, a proper takeaway and a proper golf swing.

BACKGROUND—DESCRIPTION OF PRIOR ART

In order to make a proper putting stroke that can be repeated time after time with the least amount of error it is important to stroke with the least number of moving parts. The size of the moving parts is also important—the larger the better. So the shoulders and big muscles of the back should be the dominant movers.

When making the one-piece takeaway to start the golf swing it is important to start with a body turn and a stable head position.

In order to make a proper swing you complete the turn and drive with the lower body, keeping the head at a relative stable position.

Although various devices and aids have been proposed to create the proper moves in prior art they have been restricted to swing or to putting or to the takeaway. However, none of these devices or aids have been able to combine all three aspects of practice in one practice aid or device.

Many of the prior arts are heavy, complicated and some are so restrictive as to be dangerous to the body. Some others are trying to control the dog by training the tail. While this aid concentrates on the training of the dog causing the tail to follow in the proper place.

OBJECTS AND ADVANTAGES

It is the primary object of this invention to have a simple, light and uncomplicated device that all aspects of golf can be practiced on with a very remote possibility of bodily harm.

Another object is to have a device that can be constructed from lightweight parts in a short time and can be used for practice indoors or outdoors.

It is still of further object of the present invention to provide a knee rest to stabilize the lower body in the putting stroke.

It is still further object to have a head rest to stabilize the body from the neck up. This leaves the shoulders free to move the arms, hands and putter.

It is still further object to have a guide for the putter shaft to train the muscles to take the putter directly away from the line of putting and stroke through and forward directly toward that line.

It is yet further object to use this present invention from the other side of the device to practice a proper takeaway. This is done by adjusting the head rest and guide bar while facing the other side of the device and making a turn with the knees while keeping the arms passive and the head still on the rest.

It is still a further object to remove the lower guide bar and use the device for a full swing while keeping a relative stable head position by using the head bar as a point of reference.

DRAWING FIGURES

The particular features and advantages of the apparatus, as well as other object will become apparent from the following description taken in connection with the accompanying drawings in which:

FIG. 4 shows a sectional view of the #1,2,3,4,8 and 9 which move along the pipes to make the invention adjust to any position along the bar.

FIG. 5 shows a sectional view of Part #6 with the weighted bar inside for balance.

OPERATIONAL DESCRIPTION OF FIGURES

Figure 1:
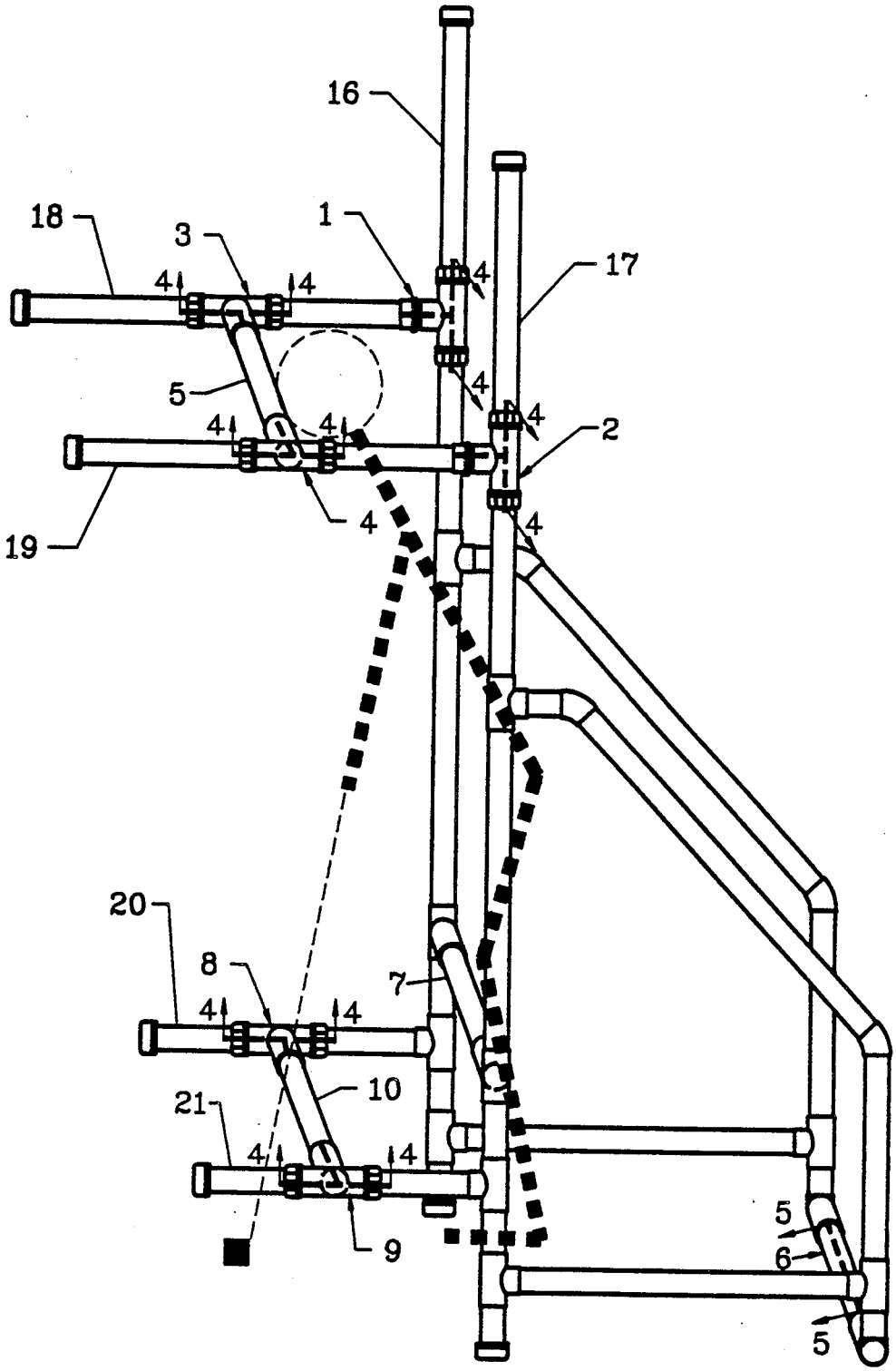
FIG. 1 shows the invention with a stick figure holding a putter in the position to practice a proper putting stroke.
Figure 2:
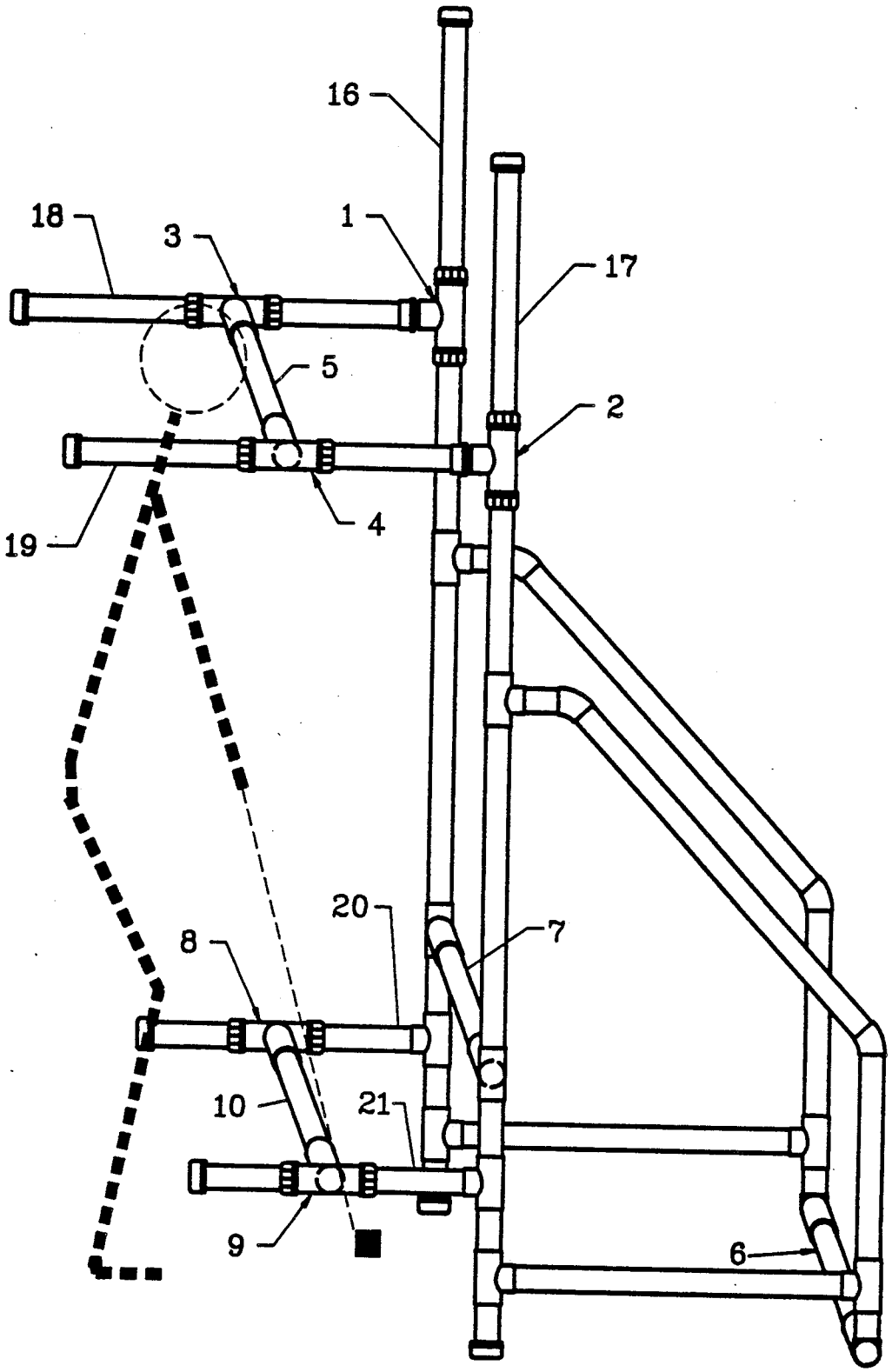
FIG. 2 shows the invention with a stick figure golfer standing on the other side where a one-piece takeaway can be practiced.
Figure 3:
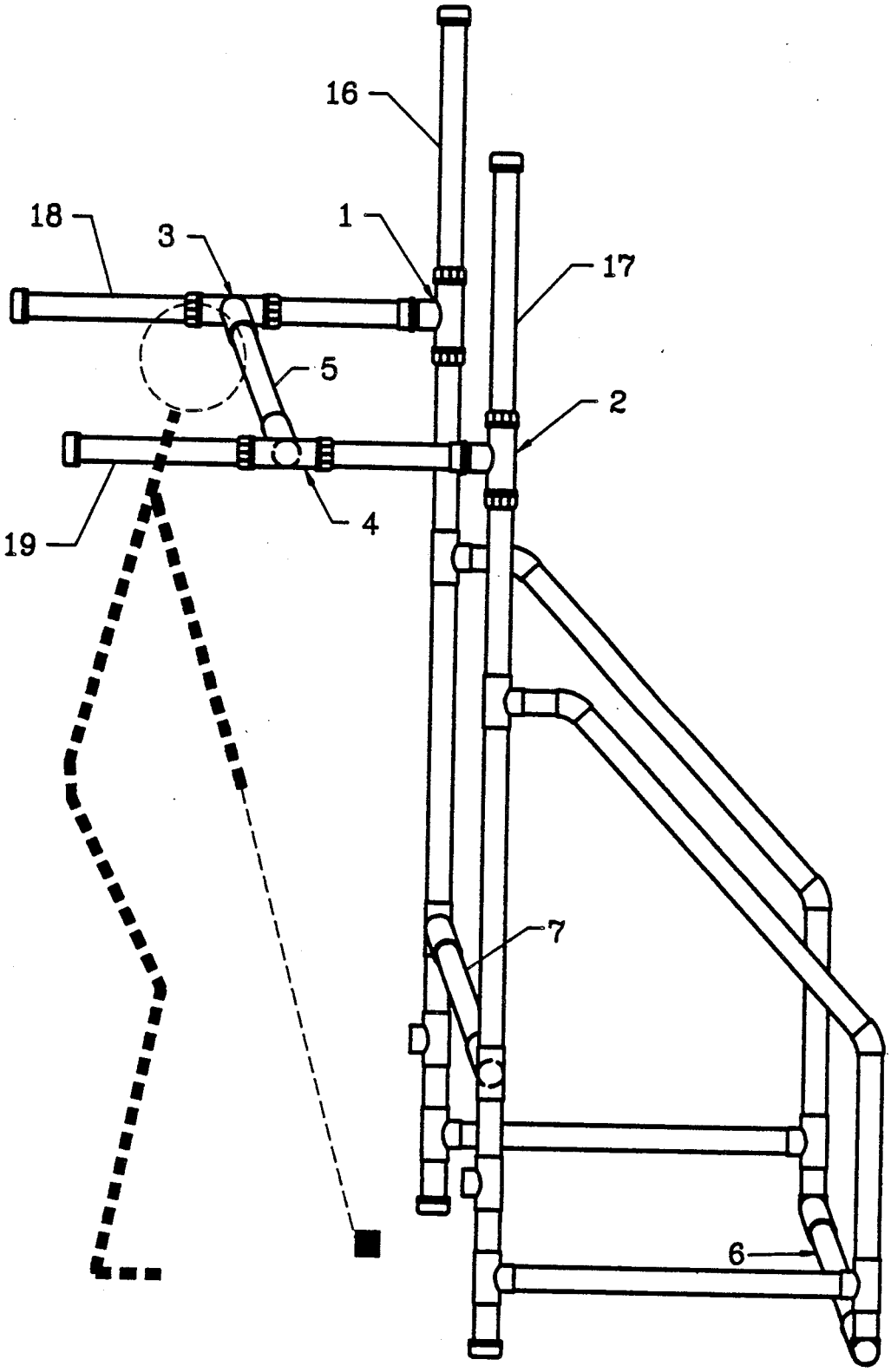
FIG. 3 shows the invention with the putting guide bar removed and a stick figure golfer in position to practice the golf swing.

Referring to the drawings and initially to FIGS. 1–3, one embodiment of a training aid for golfers in the putting mode is broadly designated by the reference numbers 7,5,10. In this mode the golfer by lightly touching his or her shins to the cross bar #7 stabilizes the entire body from the waist down. While touching the forehead to cross bar #5 the body is stabilized from the neck up. Touching the underside of the putter shaft on the far side of cross bar #10 assures the path of the putter during the stroke.

This training aid will adjust to fit all sizes and shapes of golfers. Parts #1 and #2 adjust #5 vertically along #16,17 to proper head height. Parts #3, #4 adjust #5 horizontally along #18 and #19 to position the eyes vertically over the ball. Parts #8 and #9 adjust #10 horizontally along #20 and #21 to the ball position and parallel to the putting line.

When the golfer is positioned in the device in the putting mode the movement of the putter along #10 with his or her shoulder gives the golfer the feeling of what it is like to make a proper putting stroke. In this mode the fewest number of parts are moved by the body and are being held in a stable position by the lower body. By repeating this action it will become muscle memory and a stroke that will have less chance of error.

FIG. 2—In this mode the golfer positions him or herself on the other side of the device. Using the forehead touching #5 and the surface of the shaft of the golf club on the away side of #10. The head height and horizontal positions are again adjusted by using #1,2,3,4. The horizontal position of #10 is adjusted with #8 and #9. In this position the golfer practices the first few inches of the golf swing. While in this mode the golfer will start the swing in the proper manner. The head will stay stable and he or she will start to turn rather than to sway. With the shaft on the #10 the initial move will be directly away from the target. A swing well begun is half done. Repeated moves will establish muscle memory that is proper.

FIG. 3 shows the training aid in the swing mode. #8,9,10 and the supporting tube have been removed. The golfer positions him or herself on the opposite side from the putting mode. The golfer positions his or her head to the proper height and horizontal position by adjusting #1,2,3,4 so that #5 is in the right position. Using the forehead touching #5 as a reference point the golfer can now proceed to a full swing.

FIG. 4—showing parts #1,2,3,4,8 and 9—is a drawing showing a sectional view of the adjustable portion of the device. #13 shows the coupling, where the cross bar slides in. #14 shows shows the housing of the assembly and #11 shows the threaded collar. #12 shows the rubber grommet that compresses on the pipe when the collar is tightened.

FIG. 5—Part #6 shows the drawing of a sectional view of #6 to show the weighted counter balance inside to offset the projection on the other side of the device.

I claim:

1. A golf club swing training apparatus comprising:

a frame having first and second spaced apart vertically extending bar members having forward and rearward sides;

a paid of upper horizontal forwardly extending spaced apart bar members;

means adjustably attaching one end of each of said upper horizontal members to said vertical members adjacent the upper end of a respective vertical member;

said upper horizontal members having a horizontal head rest bar extending therebetween, said bar having means adjustably attaching its ends to said upper horizontal members;

a leg rest bar extending between and attached to said vertical bar members adjacent the lower end thereof and; means extending rearwardly of said frame for supporting said frame on a supporting surface;

whereby when a golfer is positioned adjacent to the frame, with the golfer's forehead touching the head rest bar and the golfer's knees flexed and touching the leg rest bar, the golfer will be properly positioned to practice various golf strokes.

2. The apparatus of claim 1, further comprising;

a pair of lower horizontal forwardly extending spaced apart bar members; and a horizontal golf club guide bar extending between said lower horizontal bar members;

whereby when a golf club putter is slid along the club guide bar while the golfer is properly positioned touching the head and leg rest bars the golfer will be properly positioned to execute a proper putting stroke.

* * * * *